United States Patent [19]

Kämmerling et al.

[11] 4,397,450

[45] Aug. 9, 1983

[54] ARRANGEMENT FOR SECURING PLATE-TYPE COOLERS IN METALLURGICAL FURNACES

[75] Inventors: Bruno Kämmerling, Dinslaken; Franz Meier; Rainer Schmidt, both of Oberhausen, all of Fed. Rep. of Germany

[73] Assignee: M.A.N. Maschinenfabrik Augsburg-Nürnberg Aktiengesellschaft, Fed. Rep. of Germany

[21] Appl. No.: 337,438

[22] Filed: Jan. 6, 1982

[30] Foreign Application Priority Data

Jan. 8, 1981 [DE] Fed. Rep. of Germany ..... 3100321

[51] Int. Cl.[3] ..... F27B 1/24

[52] U.S. Cl. ..... 266/193; 122/6 B; 432/238

[58] Field of Search ..... 266/190–194; 122/6 B; 432/238

[56] References Cited

U.S. PATENT DOCUMENTS 4,314,695 2/1982 Widmer ..... 266/194

4,327,900 5/1982 Engel et al. ..... 266/193

*Primary Examiner*—M. J. Andrews

*Attorney, Agent, or Firm*—McGlew and Tuttle

[57] ABSTRACT

An improved arrangement for securing a plate-type cooler in metallurgical furnaces is disclosed. The cooler comprises a cast body including embedded cooling pipes provided with protective tubes which are run into the cooler body and secured to the outlets of the cooling pipes. At a first level, at least one of the protective tubes is designed as a fixed support and the other tubes at the same level are designed as horizontally displaceable supports to allow for a thermal expansion. At a vertically opposite level, at least one of the protective tubes is designed as a vertically displaceable support and the other tubes extending at the same level are designed as movable supports.

5 Claims, 6 Drawing Figures

ARRANGEMENT FOR SECURING PLATE-TYPE COOLERS IN METALLURGICAL FURNACES

FIELD AND BACKGROUND OF THE INVENTION

The invention relates to, in general, to plate-type metallurgical furnaces, and, more particularly, to a new and useful arrangement for securing plate-type coolers in metallurgical furnaces, such as blast furnaces, with the coolers being provided on the inside of the furnace shell and their coolant conducting pipes extending through openings in the furnace shell while being surrounded therein in spaced relationship by protective tubes which are run into the cooler, and with the openings in the furnace shell being sealed to prevent gas escape.

Plate-type coolers of a blast furnace cooling system are secured to the inside of the furnace shell in various ways. A known method of securing provides almost rigid attachments by welding the protective tubes surrounding the cooling pipes firmly to holding plates, or sealing caps, which in turn are welded to the furnace shell. Due to the varying expansions of the coolers, under varying heat from the furnace interior, the mentioned welds are alternately stressed, and eventually break down thereby causing leaks in the furnace.

According to another manner of securing, the coolers are held in place by bolts which are passed through the cooler plate and screwed into the furnace shell. The bolthead is countersunk in a recess on the inside. At the outside, a nut is provided that is sealed by a cap (see West German Offenlegungsschrift No. 27 43 380).

During high thermal loads on the plate-type cooler, the securing bolts suffer undue extension, or the boltheads may even melt away. The plates may then move toward the furnace center, so that reaction gas flows through the gap formed between the cooler and the furnace shell and excessively heat the shell. The protective tubes bear against the openings in the shell and cause constraints. The invention is intended to eliminate such drawbacks.

SUMMARY OF THE INVENTION

The invention is directed to an arrangement for preventing thermal expansion that produce undue constraints at the plate coolers in the fixing areas, and for insuring that, under external forces produced by an expansion of adjacent plates or by the material treated in the furnace, the coolers remain firmly anchored in their position, that the cooling pipes remain in their position relative to the furnace shell, even in instances where the cast bodies of the cooler would break under continual temperature variations, that no gas will flow between the coolers and the furnace shell, that the movements at the outer connections of the plates will be minimized, and that the openings in the furnace shell will be reliably sealed.

Accordingly, the invention provides that at least one of the protective tubes, extending in a respective horizontal plane of the plate cooler, serves as a fixed support, that the other protective tubes in the same plane are designed as horizontally displaceable supports, and that at least one protective tube, extending in a second horizontal plane and vertically, opposite to the fixed support or supports, is designed as a vertically displaceable support and the other protective tubes extending in this second plane are designed as movable supports.

In accordance with a development of the invention, the protective tube serving as the fixed support, upon being passed through the furnace shell, is firmly welded to the furnace shell by means of a holding plate. Several adjacent protective tubes may be designed as fixed supports, since the minor thermal expansion to be expected with the relatively small spacing can be taken up by the tubes themselves. The expansion of the coolers is compensated for without constraints in the fixing zones due to further provisions that a protective tube, passed through the furnace shell to form a support for horizontal displacement or vertical displacement, is provided with a holding plate which is received with horizontal or vertical play in guides which are welded to the furnace shell, and that the movable support is displaceable both horizontally and vertically, and a spacer plate is welded to the furnace shell, by which the protective tube passed through the shell is circumferentially surrounded with play spacing, and that the protective tube is secured against axial displacement in the direction of the furnace center by a holding plate.

As a result of the arrangement of horizontally displaceable supports at the same level, at both sides of the fixed supports, the expansion occurring over the entire width of the cooler plate is compensated for, however, forces acting on the cooler from above and below and exceeding the take-up capacity of the fixed supports alone, are then taken up by the guides, so that no displacement of the plates in the vertical direction occurs. The protective tube or tubes provided at a level vertically opposite to the fixed supports and being mounted for vertical displacement produces the effect that thermal expansions, in the lengthwise direction of the plates, cannot cause constrictions while lateral forces occurring due to an expansion of adjacent plates are transferred to the guides through the holding plate.

The further protective tubes run into the cooler body at this level and adjacent the vertically displaceable ones have a clearance of motion both horizontally and vertically relative to the spacer plate by which they are surrounded. Therefore, in this zone again, no constraints caused by a thermal expansion of the cooler can occur. The holding plates which are welded to all of the protective tubes prevent the cooler from moving toward the furnace center. Hot furnace gases thus cannot flow between the cooler and the furnace shell.

With the described mounting of the protective tubes, the inlet and outlet zones of the coolant conducting pipes embedded in the cast body are secured to an extent such that the position of the pipes relative to the furnace shell does not change even if cracks should appear in the cast body of the cooler due to continual temperature variations.

The invention finally provides that to seal the supporting areas against gas penetration, a tubular sleeve is welded to the holding plate, the guides, or to the spacer plate, respectively. The tubular sleeve carries a metallic compensator which is surrounded by a protective housing and connected to the coolant conducting pipe.

Accordingly, it is an object of the invention to provide an improved arrangement for securing plate-type coolers on an inside furnace shell of a metallurgical furnace, such as a blast furnace, the coolers being of the type having cooling conducting pipes extending through openings in the furnace shell, protective tubes being surrounded in spaced relationship about the pipes and extended into the cooler, and means for sealing the openings in the furnace shell to prevent gas escape, wherein the improvement includes at least one of the protective tubes spaced about a first cooling pipe extending in a respective horizontal plane of the plate cooler being mounted to the shell as a fixed support, and the other protective tubes in the same plane being mounted to the shell as horizontally displaceable supports, and at least one protective tube extending in a second horizontal plane spaced about said first cooling pipe opposite to the fixed support being mounted to the furnace shell as a vertically displaceable support and the other protective tubes extending in the second plane being mounted to the shell as movable supports.

It is a further object of the invention to provide an improved arrangement for securing plate-type coolers on the inside of a furnace shell which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION

Figure 1:
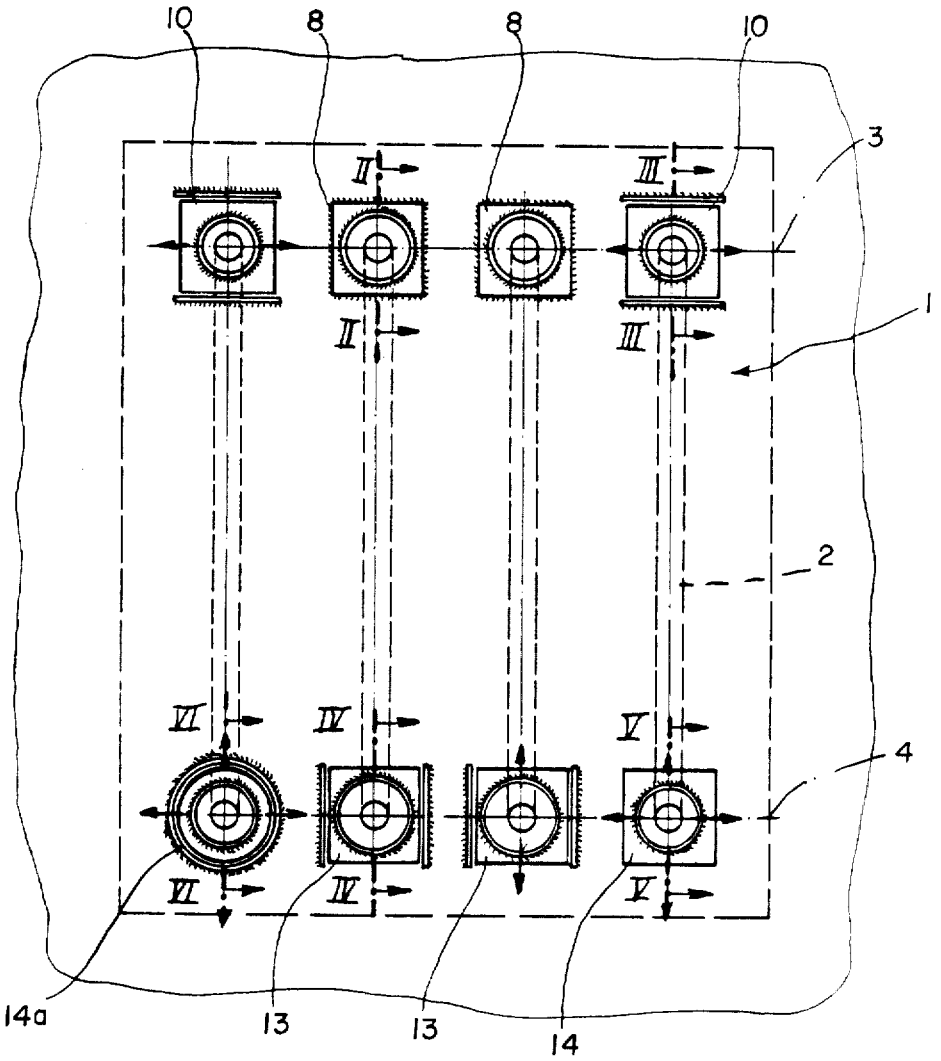
FIG. 1 is a schematic elevation view of a plate-type cooler showing different kinds of support.

Referring now to the drawing, in particular, wherein like reference numerals refer to like or corresponding parts throughout the several views, there is shown a cooler 1 having four coolant conducting pipes 2 which are embedded, parallel to each other, in a cast cooler plate 21, and project from this plate at levels 3 and 4.

The cooling pipes 2, are surrounded, concentrically in the illustrated embodiment, by protective tubes 5 in the vicinity of their inlets and outlets. The protective tubes 5 are run into the cast body or plate and project from the contact face thereof.

While mounting the cooler on the inside of a furnace shell 6, the cooling pipes 2, as well as the projecting protective tubes 5, are passed through openings 7 provided in shell 6. The protective tubes 5 are utilized for securing the cooler.

Figure 2:
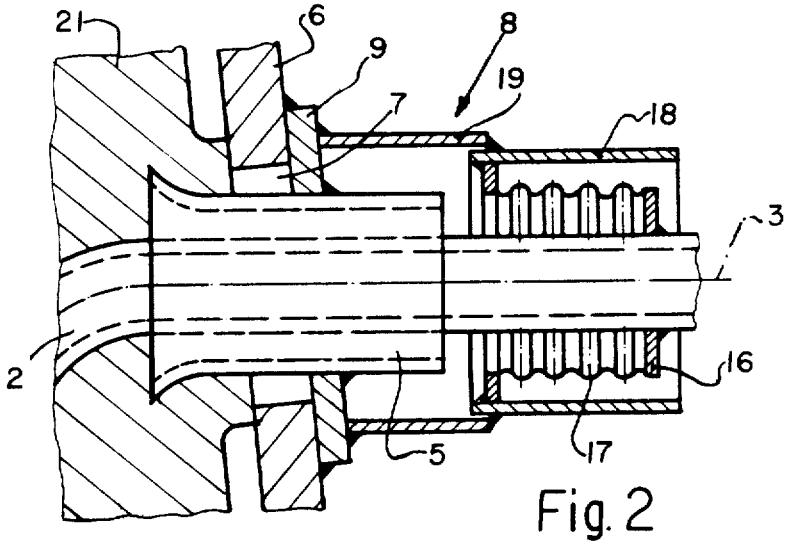
FIG. 2 is a sectional view of the fixed support taken along the lines II—II of FIG. 1.

At horizontal level 3, as shown in FIG. 2, the two innermost protective tubes 5 are designed as fixed supports 8. To this end, a holding plate 9 covering opening 7 is welded to both the respective protective tube 5 and to furnace shell 6.

Figure 3:
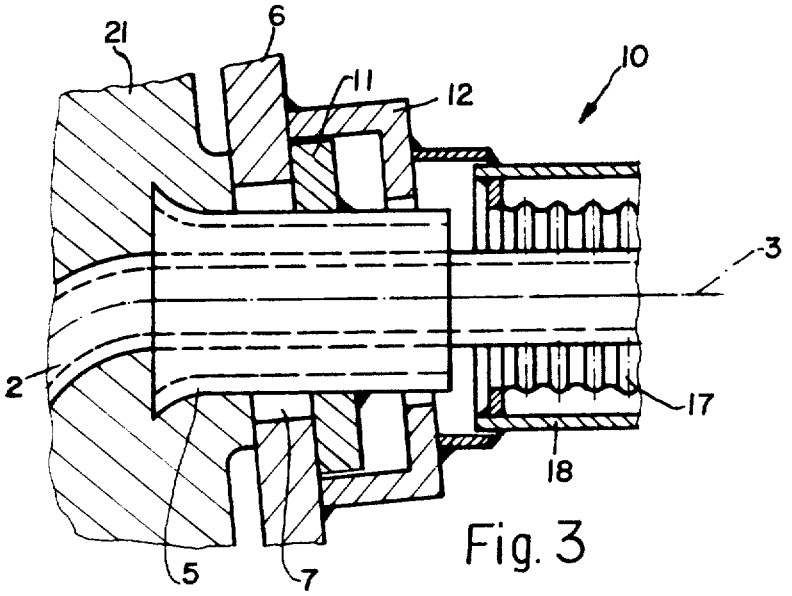
FIG. 3 is a similar view of the horizontally displaced support taken along the line III—III of FIG. 1.

At the same level 3, adjacent to the two innermost fixed supports 8, outer horizontally displaceable supports 10 are provided (FIG. 3). For this purpose, a holding plate 11 is welded to protective tube 5 and received in a guide 12 permitting a displacement, thus an expansion, only in the horizontal direction. Holding plate 11 slides on furnace shell 6.

Figure 4:
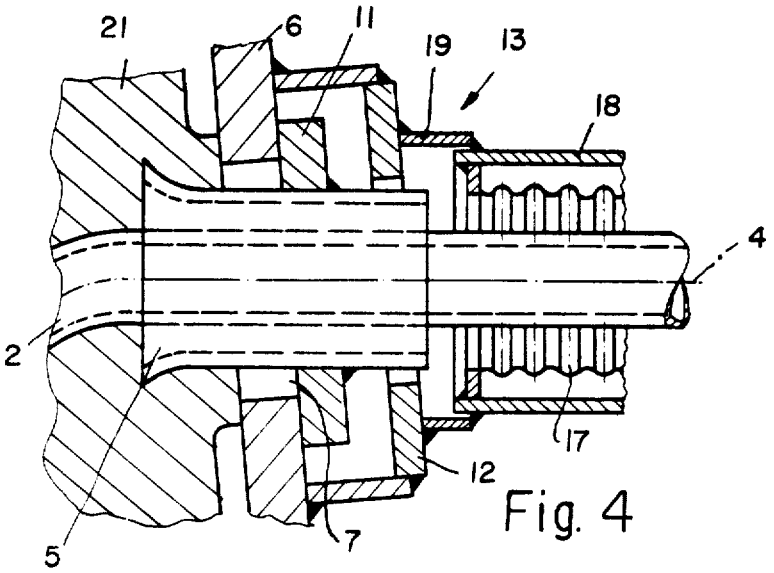
FIG. 4 is a similar view of the vertically displaceable support taken along the line IV—IV of FIG. 1.
Figure 5:
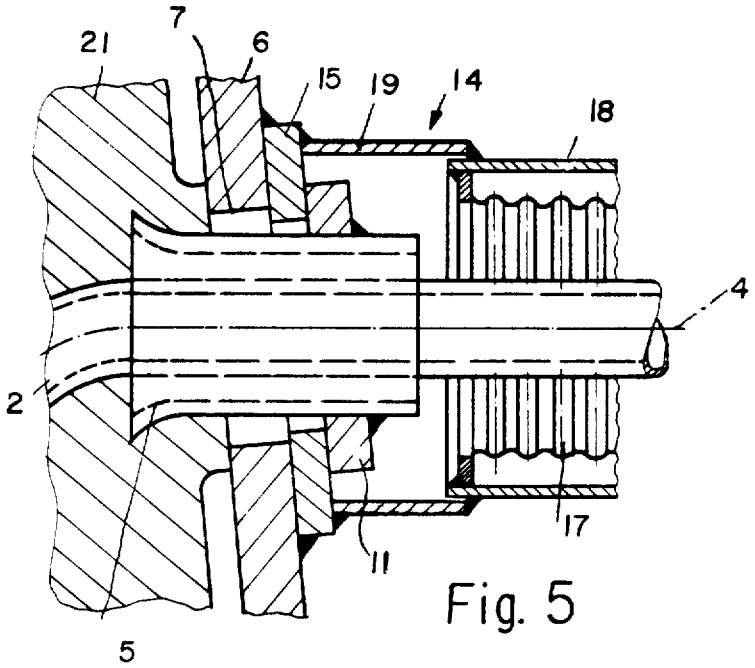
FIG. 5 is a similar view of the movable support taken along the line V—V of FIG. 1.

At the lower end of the cooler plate, that is, at level 4, two vertically displaceable supports 13 (FIG. 4) are provided opposite fixed supports 8. Here again, a holding plate 11 is welded to protective tube 5 and received in a guide 12 which is turned through 90° relative to guides 12 at the upper level. Upon a thermal expansion of the cooler plate in the direction of the longitudinal axis thereof, holding plate 11 slides on furnace shell 6 vertically. Adjacent the two vertically displaceable supports 13, at either side at level 4, movable supports 14 are provided allowing for an expansion in both the horizontal and vertical directions (FIG. 5). In this support, a spacer plate 15 welded to furnace shell 6 circumferentially surrounds the protective tube 5 with play. Holding plate 11 which again is welded to protective tube 5 applies against spacer plate 15 and secures the protective tube against axial displacement toward the furnace center.

Figure 6:
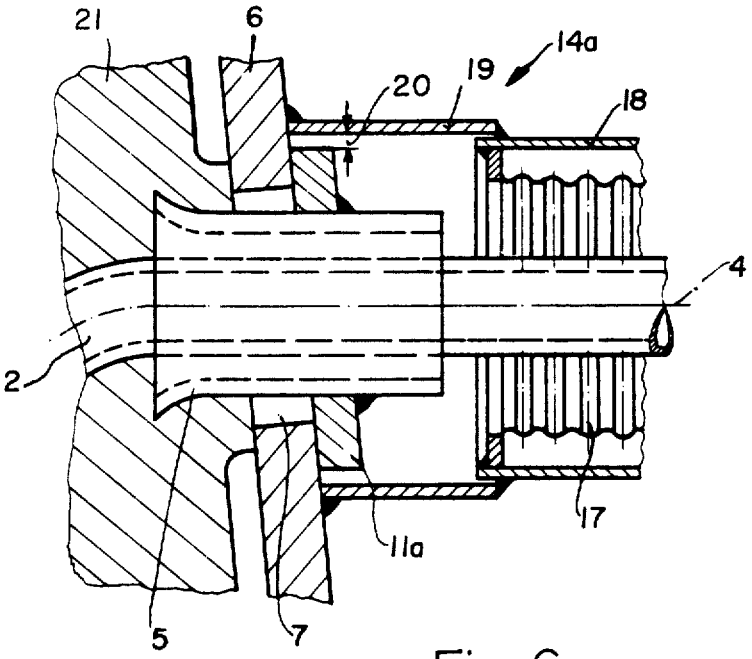
FIG. 6 is a similar view of another embodiment of the movable support taken along the line VI—VI of FIG. 1.

FIG. 6 shows another embodiment of movable support **14*a*. In this design, a circular holding plate 11*a*, welded to protective tube 5, can move only within a clearance 20 formed by a surrounding tubular connection 19, and permitting a free thermal expansion of cooler 1. A displacement of the cooler under forces acting from the outside is prevented, since upon being displaced through clearance 20, holding plate 11*a* butts against the inside of tubular connection 19**.

Since gases from the furnace might escape through the annular gap around protective tubes 5 in opening 7 of furnace shell 6, the supports of the cooler are sealed. For this purpose each cooling tube 2 is connected through a plate 16 to a metallic compensator 17 which is surrounded by a protective housing 18 and gas-tightly welded, through tubular connection 19, to holding plate 9, guide 12, and spacer plate 15, or directly to furnace shell 6.

Thus, in accordance with the invention an arrangement is provided for securing plate-type coolers in metallurgical furnaces, such as blast furnaces. The coolers are provided on the inside of the furnace shell and their coolant conducting pipes extending through openings in the furnace shell. The pipes are surrounded in the openings in spaced relationship by protective tubes which extend into the cooler. The openings in the furnace shell are sealed to prevent gas escape. The inventive arrangement is characterized in that at least one of the protective tubes 5, extending in a respective horizontal plane 3 of the plate cooler, serves as a fixed support 8, and the other protective tubes in the same plane are designed as horizontally displaceable supports 10, and that at least one protective tube, extending in a second horizontal plane and vertically opposite to the fixed support or supports 8 is designed as a vertically displaceable support 13 and the other protective tubes extending in this second plane 4 are designed as movable supports 14.

In accordance with a preferred embodiment, the protective tube 5 serving as the fixed support 8, passed through shells 6, is firmly welded to the furnace shell by means of a holding plate 9.

A protective tube passed through the furnace shell 6 to form a support for horizontal displacement 10 or vertical displacement 13 is preferably provided with a holding plate 11 which is received with horizontal or vertical play in guides 12 which are welded to the furnace shell 6.

The movable support 14 is displaceable both horizontally and vertically, and a spacer plate 15 is welded to the furnace shell 6, by which the protective tube 5 passed through the shell is circumferentially surrounded with play, and the protective tube is secured against axial displacement in the direction of the furnace center by a holding plate 11.

To seal the supporting areas against gas penetration, a tubular sleeve 19 is welded to the holding plate 9, the guides 12, or to the spacer plate 15, respectively, carrying a metallic compensator 17 which is surrounded by a protective housing 18 and connected to the coolant conducting pipe 2.

Thus, to secure plate-type coolers 1 to the inside of metallurgical furnaces such as blast furnaces, the cast body of each cooler, including embedded cooling pipes 2, is provided with protective tubes 5 which are run into the cooler body and secured to the outlets of the cooling pipes. The protective tubes extend in the area of respective openings 7 provided in the furnace shell 6, and after they are passed through the openings, holding plates 9 or 11 are welded thereto. At one level 3 of cooler 1, at least one protective tube 5 is designed as a fixed support 8, i.e., the tube is welded by holding plate 9 to the furnace shell. The other tubes 5 provided at the same level are designed as horizontally displaceable supports 10 to allow for a thermal expansion. This also takes up forces acting on the cooler in the vertical direction. At a vertically opposite level 4, at least one of the protective tubes 5 is designed as a vertically displaceable support 13, while the other tubes extending at the same level are designed as movable supports 14, i.e, supports which are displaceable both horizontally and vertically. In the supports which are displaceable in one direction only (10, 13) or in both directions (14), the holding plates 11 welded to the protective tubes slide on the furnace shell 6 during a thermal expansion of the cooler.

The openings 7 in the furnace shell are sealed against escape of gases.

While specific embodiments of the invention have been shown and described in detail to illustrate the application of the principles of the invention, it will be understood that the invention may be embodied otherwise without departing from such principles.

What is claimed is:

1. An improved arrangement for securing plate-type coolers on an inside furnace shell of a metallurgical furnace, such as a blast furnace, the coolers being of the type having coolant conducting pipes extending through openings in the furnace shell, protective tubes being surrounded in spaced relationship about the pipes and extended into the cooler, and means for sealing the openings in the furnace shell to prevent gas escape, the improvement comprising at least one of the protective tubes spaced about a first coolant conducting pipe extending in a respective horizontal plane of the plate cooler being mounted to the shell as a fixed support, and the other protective tubes in the same plane being mounted to the shell as horizontally displaceable supports, and at least one protective tube extending in a second horizontal plane spaced about said first coolant conducting pipe opposite to the fixed support being mounted to the furnace shell as a vertically displaceable support, and the other protective tubes extending in the second plane being mounted to the shell as movable supports.

2. The improved arrangement as set forth in claim 1, further comprising a holding plate fixedly welded to said furnace shell and to the protective tube defining said fixed support.

3. The improved arrangement as set forth in claims 1 or 2 further comprising a movable holding plate fixed welded to each of said protective tubes defining the horizontally displaceable supports and the vertically displaceable support, guides weldedly mounted to the shell, and each of said movable holding plates being received in a respective one of said guides with one of a vertical and horizontal clearance therebetween.

4. An improved arrangement as set forth in claim 3, wherein said movable support is displaceable both horizontally and vertically, and further comprising a spacer plate welded to the furnace shell in spaced relationship about said other protective tubes, and means for securing said protective tubes against axial displacement in the direction of the furnace center.

5. An improved arrangement as set forth in claim 4, wherein said sealing means comprise a tubular sleeve welded to one of said first mentioned holding plate, said guides, and said spacer plate, a protective housing, and a metallic compensator surrounded by said protective housing connected to said coolant conducting pipe.

* * * * *